United States Patent [19]

Chen et al.

[11] 4,344,227

[45] Aug. 17, 1982

[54] CLEAN-OUT MECHANISM FOR TWIN BLADE SHAVING UNIT

[75] Inventors: Evan N. Chen, Fairfield; James S. Emmett, Ansonia; Frank A. Ferraro, Trumbull; Anthony J. Peleckis, Trumbull, all of Conn.

[73] Assignee: Warner-Lambert Company, Morris Plains, N.J.

[21] Appl. No.: 180,756

[22] Filed: Aug. 25, 1980

Related U.S. Application Data

[63] Continuation of Ser. No. 971,170, Dec. 20, 1978, abandoned, which is a continuation of Ser. No. 866,127, Dec. 30, 1977, abandoned.

[51] Int. Cl.[3] ..... B26B 21/22

[52] U.S. Cl. ..... 30/41

[58] Field of Search ..... 30/41

[56] References Cited

U.S. PATENT DOCUMENTS 3,972,114 8/1976 Chao ..... 30/41

4,047,296 9/1977 Ishida et al. ..... 30/41

4,226,019 10/1980 Sugiyama ..... 30/41

FOREIGN PATENT DOCUMENTS 51-70692 1/1976 Japan ..... 30/41

*Primary Examiner*—Jimmy C. Peters

*Attorney, Agent, or Firm*—R. S. Strickler

[57] ABSTRACT

An improved twin blade razor system having a unitary member positioned between the pair of blades for both spacing the blades and ejecting shaving debris from that space. The unitary member, which may conveniently be of injection molded plastic, includes a spacer portion, an ejector portion, and biasing apparatus connecting the ejector portion and the spacer portion for biasing the ejector portion to a normally retracted position relative to the blades and spacer. The ejector portion is manually displaceable to an advanced ejecting position. The biasing portion may be one or more beam springs connected and configured to reduce distortion and/or stressing of the relatively moving portions of the member during actuation.

10 Claims, 9 Drawing Figures

CLEAN-OUT MECHANISM FOR TWIN BLADE SHAVING UNIT

This is a Continuation of application Ser. No. 971,170 filed Dec. 20, 1978, which in turn was a Continuation of U.S. application Ser. No. 866,127 filed Dec. 30, 1977, both abandoned.

BACKGROUND OF THE INVENTION

The present invention relates generally to a shaving blade unit for use in or forming part of safety razors and, more specifically, to a twin-bladed shaving unit having means for ejecting debris including shaved hair particles deposited in and clogging the space between the leading and following cutting edges provided by the pair of blades.

Twin-bladed safety razors are believed to possess desirable shaving characteristics. Such razors include two blade elements disposed parallel to each other in spaced relation and each having a cutting edge such that the pair provide leading and following cutting edges so that both cutting edges are successively active with respect to the hair elements or whiskers being cut during a shaving stroke. A representative example of a twin-bladed shaving cartridge is illustrated in U.S. Pat. No. 3,890,704 by Ferraro for Razor Blade Cartridge issued June 24, 1975.

While shaving with a twin-bladed safety razor, various types of debris such as shaved hair and whisker particles and shaving lather are gradually deposited in and thus clog the space between the leading and following cutting edges of the twin-bladed shaving unit. These deposits may adversely affect the shaving characteristics of the razor so that it customarily must be removed at some appropriate time or times before, during or after shaving. Until recently, most prior art twin-bladed shaving units did not in general include a means for ejecting the shaving debris and, accordingly, removal of that debris had to be accomplished by relatively difficult and time-consuming techniques, such as washing, for example.

One effort directed to overcoming the above problem is disclosed in U.S. Pat. No. 3,972,114 to Chao et al for Self-Cleaning Mechanism for Twin Blade Razors issued Aug. 3, 1976, wherein a self-cleaning mechanism is arranged between the blades of a twin blade razor whereby the area between the blades can be made clean and free of debris by movement of the cleaning mechanism with a person's fingers. This cleaning mechanism, however, is operated by manual reciprocatory motion in a direction parallel to the blade edges. Teeth on the forward edge of the mechanism have inclined surfaces for forwardly displacing debris from between the blades; however, such arrangement is less than totally efficient in removing debris due to the limited number of teeth, the incline angle of the teeth, and the limited range of lateral displacement of the cleaning mechanism.

The U.S. Pat. No. 4,047,296 to Ishida et al for Two-Edge Shaving Blade Unit Having Anti-Clogging Means issued Sept. 13, 1977, discloses a clean-out mechanism, and additionally includes biasing means for normally retaining the ejector in its retracted position. However, the spacer, the ejector, and the biasing means comprise three separate elements which serve to complicate the assembly of the shaving unit.

Accordingly, it is a primary object of the present invention to provide an improved twin blade razor system which overcomes the above disadvantages encountered with the prior art units.

It is a further object of the invention to provide a twin blade shaving system having improved means for cleaning debris from between the blades. Included in this object is the provision of spacer and ejector means having a reduced initial cost, affording reduced assembly costs in the manufacture of the shaving system, providing increased durability, and/or affording superior debris clean-out characteristics.

SUMMARY OF THE INVENTION

In accordance with the present invention, there is provided an improved razor blade system of the type employing a pair of spaced razor blades with cutting edges on the forward edges thereof fixedly positioned between seat and cap portions. More specifically, the improvement comprises unitary means interposed between the pair of razor blades for maintaining the blades in their spaced relation and for ejecting shaved hair from therebetween.

More specifically, the unitary spacer and ejecting means comprises a spacer portion fixed between the seat and cap portions, an ejector portion for displacement between advanced and retracted positions relative thereto, and a biasing portion fixed to the spacer portion and the ejector portion for normally retaining the ejector portion in the relatively retracted position, the ejector portion being manually displaced to the advanced position for ejecting shaved hair. The ejector and biasing portions may be of slightly lesser thickness between the blades than the spacer portion.

In a preferred embodiment, the spacer portion comprises two laterally spaced and laterally elongated segments each connected to the ejector portion by a respective beam spring. Each beam spring is so configured and connected to the ejector portion and respective spacer segment to reduce distortion during displacement of the ejector portion.

DESCRIPTION OF PREFERRED EMBODIMENTS

Figure 1:
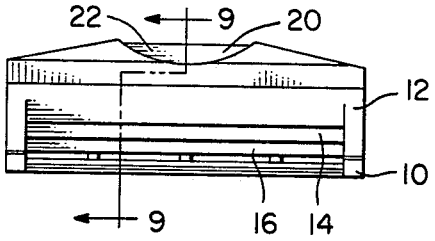
FIG. 1 is a plan view of an embodiment of a twin blade shaving unit in accordance with the invention.

Referring to FIGS. 1, 2, 6 and 9, the twin blade shaving unit or system illustrated includes a seat portion 10 and a cap portion 12, both of which may be of plastic material. An upper or cap blade element 14 and a lower or seat blade element 16 are fixed between the platform and cap portions 10, 12 in a parallel and spaced relation with the one-piece or unitary spacing and clean-out mechanism 19 of the invention interposed therebetween. The cap 12, the seat 10, and the upper and lower blade elements 14, 16 are substantially of the type illustrated and described in the aforementioned U.S. Pat. No. 3,890,704 to Ferraro, an exception being the tapered extension to the rear surfaces of cap 12 and seat 10 and a relief slot 20 centered therein to facilitate location and operation of the clean-out or ejector portion 22 of the unitary member 19.

Figure 2:
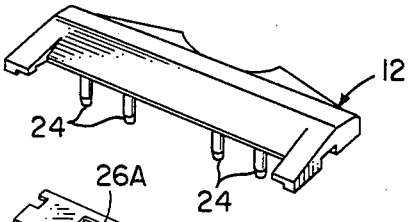
FIG. 2 is a perspective view of the cap portion of the unit shown in FIG. 1.
Figure 3:
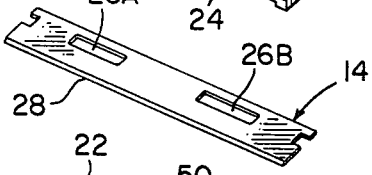
FIG. 3 is a perspective view of an upper blade element of the unit shown in FIG. 1.
Figure 9:
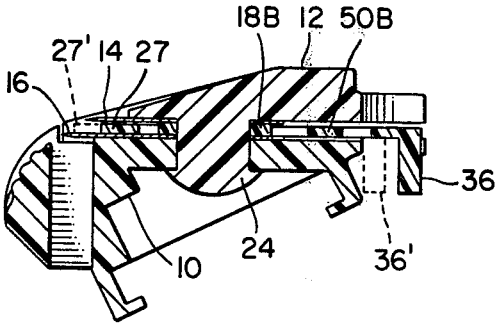
FIG. 9 is a sectional view taken along the line 9—9 in FIG. 1.

As partially illustrated in FIGS. 2 and 9, the cap 12 has four posts 24 projecting from its inner wall surface, the lateral spacing between the first and second and the third and fourth posts being the same and less than that between the second and third posts. The posts 24 serve as members for fixing in position the upper and lower blade elements 14, 16 and the spacer portion 18 of the unitary spacing and clean-out mechanism 19. FIG. 3 shows the upper blade element 14 formed towards its opposite lateral end portions with laterally extending slots 26A and 26B respectively. The upper blade element 14 is disposed with its upper surface contacting the inner wall surface of cap 12 and with its cutting edge 28 directed forwardly. Further, the upper blade element 14 is fixed in position with its slots 26A, 26B fitted onto respective equally spaced pairs of posts 24, as by vertically assembling the elements of FIGS. 2 and 3.

Figure 5:
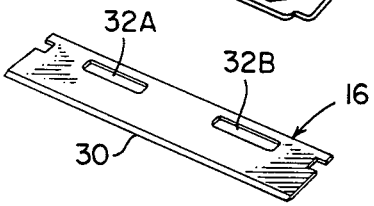
FIG. 5 is a perspective view of a lower blade element of the unit of FIG. 1.
Figure 6:
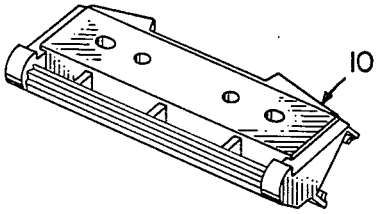
FIG. 6 is a perspective view of the seat portion of the unit of FIG. 1.

The lower blade element 16 of FIG. 5 is disposed between the seat and cap 10, 12 respectively with its lower surface contacting the inner wall surface of the seat 10, and with its cutting edge 30 directed forwardly. The lower blade 16 is substantially identical in structure with the upper blade 14, except that slots 32A and 32B of the lower blade 16 are positioned slightly more rearward relative to cutting edge 30 than are slots 26A, 26B relative to cutting edge 28. For assembly, the slots 32A, 32B are fitted onto respective equally spaced pairs of posts 24 of cap 12. Consequently, when the upper and lower blade elements 14, 16 are assembled, the cutting edge 30 of the lower blade 16 is slightly advanced as compared with the cutting edge 28 of the upper blade element 14, thus providing the leading and following cutting edges, respectively.

Figure 4:
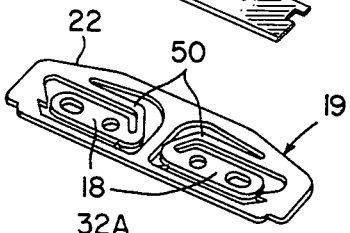
FIG. 4 is a perspective view of a one-piece spacer and ejector in accordance with the invention and utilized in the spacer of the unit of FIG. 1.
Figure 7:
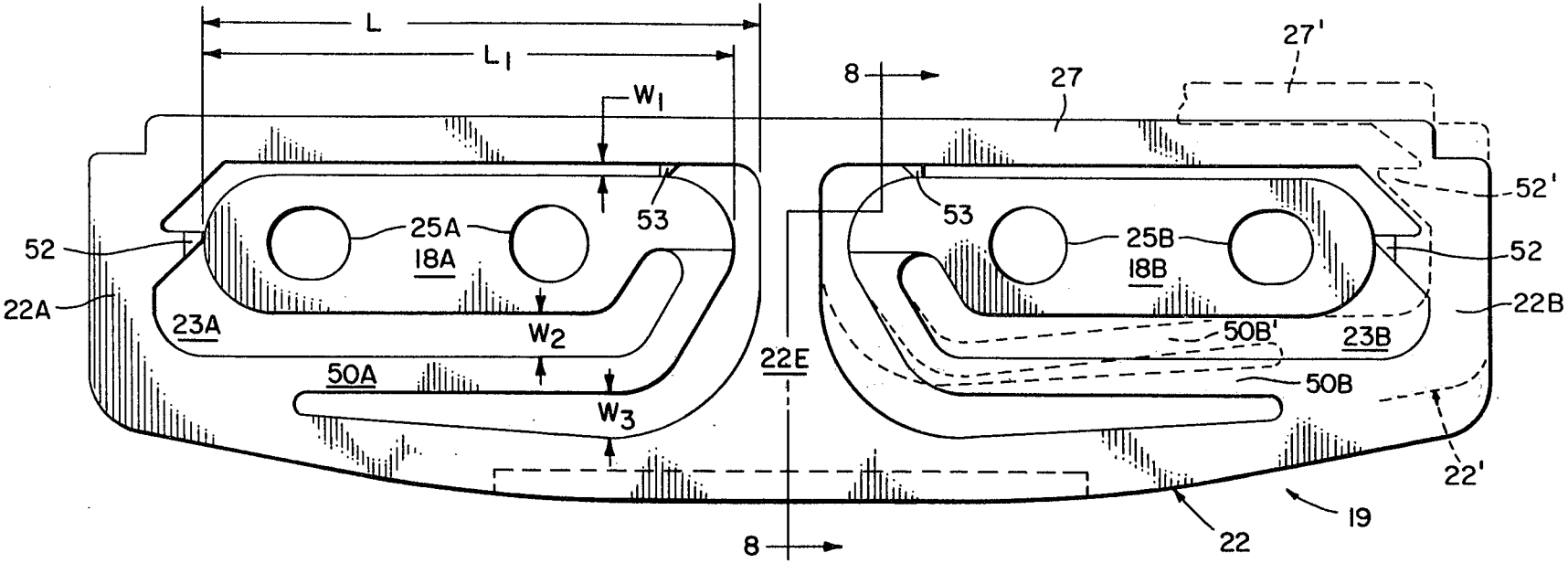
FIG. 7 is an enlarged plan view of the unitary spacer and ejector member of FIG. 4.
Figure 8:
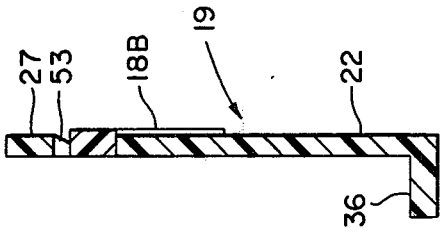
FIG. 8 is a sectional view taken along the line 8—8 in FIG. 7.

Referring now to FIGS. 4, 7 and 8, the unitary spacing and clean-out member 19 is comprised of a spacer portion 18, an ejector portion 22, and interconnecting biasing means 50. The combination spacer-ejector member 19 is formed of a material which is preferably easy and inexpensive to mass-produce, yet readily resists the high temperatures of shaving rinse water and the chemical attack of various toiletries and possesses high strain resistance and the capacity to act as a spring in thin sections. Applicants have found high temperature thermoplastics such as acrylic-butyl styrene (e.g., CYCOLAC-T by Borg-Warner) to be particularly satisfactory. Of course, other materials such as the 400 series of stainless steels and 4000, 5000 and 6000 series of aluminum alloys might also be generally suitable but would possess certain obvious limitations. The plastic member 19 of the illustrated embodiment is conveniently formed by injection molding.

The geometry of the combined spacer and clean-out member 19 is now considered in greater detail. The spacer portion 18 is comprised of a pair of identical, thin, laterally spaced and laterally elongated spacer segments 18A and 18B respectively. The lateral elongation of each spacer segment 18A, 18B is sufficient for the formation of a pair of post holes 25A, 25B respectively therein. Post holes 25A, 25B are positioned and sized for a respective pair of posts 24 to pass therethrough and fixedly position the respective spacer segments relative to cap 12 and seat 10. The thickness of spacer segments 18A, 18B is selected as the desired spacing between upper and lower blades 14, 16 thereby to establish such spacing when positioned in mutual contact therebetween. Typically, the thickness of the spacer portion 18 will be about 0.020 inch.

The ejector portion 22 is substantially flat and, in this embodiment, has openings 23A, 23B adapted to fit partially around spacer segments 18A, 18B respectively. Ejector portion 22 is slightly thinner than spacer segments 18A, 18B and is of laterally elongated shape. More specifically, the ejector portion 22 of this embodiment comprises a generally rectangular, rigid framework comprising a forward ejector bar 27 spanning a generally E-shaped supporting framework. The middle arm 22E of that framework extends or passes between the laterally spaced spacer segments 18A, 18B to transfer displacement to ejector bar 27. Additionally, the end arms 22A and 22B of the E-shaped framework contribute additional support to ejector bar 27. A push tab 36 depends from the rear edge of ejector portion 22 for manual actuating engagement, as by a user's thumb. It will be appreciated that end support arms 22A and 22B might be omitted and yet retain the general functionality and operability of the mechanism. Alternatively, center arm 22E might be omitted.

The biasing means 50 connecting the spacer portion 18 with the ejector portion 22 is comprised of beam springs 50A and 50B connecting the ejector portion 22 with spacer segments 18A and 18B respectively. Like the ejector portion 22, beam springs 50A, 50B are slightly thinner than spacer segments 18A, 18B to allow their relative forward and back movement between blades 14, 16. Typically, both the ejector portion 22 and beam springs 50A and 50B are about 0.018 inch thick. It will be appreciated, however, that in cartridges of typical construction, such reduction in thickness may not be necessary. Springs 50A, 50B are about 0.035 inch wide along their length.

In the illustrated embodiment, beam springs 50A, 50B each have a so-called dogleg shape, one portion of the dogleg being anchored at an end through integral connection with the laterally-inboard end of a respective spacer segment and extending rearwardly therefrom and the other portion of the dogleg extending laterally outward behind the respective spacer segment and being anchored at its end by integral connection with ejector portion 22 rearwardly of the respective spacer segment. The rearwardly extending portion of each spring 50A, 50B is capable of a small angular deflection toward the respective laterally-outward end of spacer segment 18A, 18B when the ejector portion 22 is advanced, thereby to compensate for any laterally-inward movement of the ejector-connected end of the respective spring as it deflects angularly about the intersection of the two portions of the dogleg during the advance. The dotted-line position of spring 50B in FIG. 7 illustrates these angular deflections of the respective portions of the dogleg of the spring, revealing that the ejector-connected end of the spring moves substantially normal to the cutting edges 28, 30. This action reduces distortion of the ejector portion 22 and excessive stressing of springs 50A, 50B which could otherwise result if there was but one pivoting portion to a spring. In such instance, the ejector portion 22 would be forced to deform to accommodate the non-linear displacement path of the "moving" end of the spring.

Referring further to FIG. 7, the ejector portion 22 of member 19 in its relatively retracted position to which it is normally biased is shown in solid-line form. In that configuration, the spacing normal to cutting edges 28, 30 between the ejector bar 27 and the spacer portion 18 is denoted $W_1$ and is typically 0.017 inch, between spacer portion 18 and the laterally extending portions of the springs 50A, 50B is denoted $W_2$ and is typically 0.050 inch, and between that same portion of the springs and the rear cross-member of ejector portion 22 is denoted $W_3$ and typically increases from 0.025 to 0.050 inch toward the midline of member 19. Further, the lateral length L between center arm 22E of ejector portion 22 and the inboard end of a respective breakaway tab 52 may be 0.575 inch and is sufficiently greater than the lateral length $L_1$ of a spacer segment 18A, 18B to facilitate relative fore and aft movement of ejecting portion 22.

Side breakaway tabs 52 and front breakaway tabs 53 are integrally formed with and connect ejector portion 22 with spacer portion 18 to stabilize these elements during assembly of the shaving unit. The breakaway tabs 52, 53 are quite thin at their point of connection with spacers 18A, 18B (see FIG. 8). Upon completion of assembly, a forwardly directed manual or mechanical force is applied to the push tab 36 sufficient to cause tabs 52 and 53 to break away from their engagement with spacer portions 18, thereby and thereafter permitting fore and aft displacement of ejector portion 22 relative to spacer portion 18.

The dotted-line section of FIGS. 7 and 9 illustrates ejector portion 22 displaced from its normally retracted position to its advanced position. Typically the magnitude of that displacement is about 0.050 inch and is determined by the push tab 36 contacting the rear surface of seat 10 and/or the laterally outboard end of springs 50A, 50B contacting spacer portion 18. The primed reference numerals refer to the corresponding elements displaced to the relatively advanced position. In this advanced position, the leading edge of ejector bar 27' is positioned forwardly of the upper or following cutting edge 28 to clear and expose debris deposited between the blades for simple rinsing away with a stream of water. The thickness of ejector bar 27, being nearly that of spacer portion 18, is sufficient to sweep debris from substantially the entire space between blades 14, 16 when manually actuated. When the actuating force is released from push tab 36, beam springs 50A, 50B act to return ejector portion 22 to its normally retracted position entirely to the rear of cutting edges 28 and 30, whereupon shaving may be resumed.

The various curves and corners in the aforedescribed spacer and clean-out member 19 are contoured to permit easy and reliable operation without overstressing any portion of it. The resulting member is particularly suited to use with existing twin blade cartridge designs, requiring relatively little modification thereof.

The invention may be embodied in yet other specific forms without departing from the spirit or essential characteristics thereof. For instance, the beam springs might be positioned forwardly rather than rearwardly of the spacer portion if other geometry permits. Thus, the present embodiments are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a razor blade system including a seat portion, a cap portion, and a pair of razor blades with cutting edges on the forward edges thereof fixedly positioned between the seat and cap portions, the blades being in spaced relation to each other, the improvement comprising:

integral means interposed between said pair of razor blades defining spacer means for maintaining said blades in said spaced relation and ejector means resiliently connected to said spacer means for ejecting shaving debris from therebetween, said spacer means and said resiliently connected ejector means including an ejector bar being molded in unitary fashion to define a single piece-part all fabricated from the same starting material said single piece-part including breakaway tabs to afford temporary rigidity to facilitate handling during manufacture of the blade system.

2. The razor blade system of claim 1 wherein said spacer, said ejector, and said biasing portions between said pair of razor blades are substantially flat, said spacer portion being elongated substantially parallel to the cutting edges of said blades.

3. The razor blade system of claim 2 wherein said spacer portion comprises two laterally spaced spacer segments, said biasing portion comprises two biasing segments and said ejector portion passes between said spaced spacer segments, said two biasing segments each being connected between said ejector portion and a respective one of said two spacer segments.

4. The razor blade system of claim 3 wherein said ejector portion substantially entirely surrounds said spacer segments.

5. The razor blade system of claim 4 wherein plural posts extend from one of said cap and said seat to the other thereof in mutual connecting and aligning relationship and said spacer segments include respective openings therethrough through which said posts pass to fixedly position said spacer segments.

6. The razor blade system of claim 4 wherein each said biasing segment comprises a resilient beam spring connected at one end to a respective said spacer segment and at the other end to said ejector portion, each said beam spring being so connected to said respective spacer segments and said ejector portion and so configured that said ejector portion is repeatably displaceable between said retracted and advanced positions free of incapacitating distortion.

7. The razor blade system of claim 6 wherein each said beam spring has substantially a dogleg shape, one portion of said dogleg being anchored at its end to one side of said respective spacer segment and extending rearwardly therefrom and the other portion of said dogleg extending generally laterally behind said respective spacer segment and being anchored at its end to said ejector portion.

8. The razor blade system of claim 1 wherein said biasing portion comprises a resilient beam spring connected at one end to said spacer portion and at the other end to said ejector portion.

9. In a razor device of the type including a plurality of spaced, fixed cutting blades having parallel cutting edges the improvement comprising:

a discrete member denoting a separate entity molded as a single piece-part sandwiched between a pair of said blades, said member defining a spacer portion and an ejector portion, said ejector portion including an ejector bar, resilient means connecting said spacer portion to said ejector portion, means for fixing said spacer portion to said pair of blades, and manually operable means to move said ejector portion and said ejector bar relative to said pair of blades and relative to said spacer portion in opposition to said resilient means to purge said blades of debris, said ejector bar being parallel to said cutting edges in all relative positions of the bar.

10. In a razor device of the type including a plurality of spaced, fixed cutting blades the improvement comprising:

a unitary, flat, generally planar member defining an assembly disposed between a pair of blades, said assembly comprising a fixed spacer portion, and a movable ejector portion and resilient means joining said portions whereby said ejector portion is movable relative to said spacer portion without destroying the unitary integrity of the assembly, said assembly including breakaway tabs to afford temporary rigidity to facilitate handling during manufacture of the razor device.

* * * * *